United States Patent [19]

Witkoff

[11] 3,942,632

[45] Mar. 9, 1976

[54] JEWELRY BOX

[75] Inventor: Robert S. Witkoff, Glen Cove, N.Y.

[73] Assignee: The Alsten Company, Jersey City, N.J.

[22] Filed: Sept. 3, 1974

[21] Appl. No.: 502,505

[52] U.S. Cl. ..... 206/45.2; 206/508; B65D/21/02

[51] Int. Cl.[2] ..... B65D 25/24

[58] Field of Search .... 206/45.2, 45.11, 508, 45.19, 206/76

[56] References Cited

UNITED STATES PATENTS

| | | | |
|---|---|---|---|
| 193,366 | 7/1877 | Dreyfus | 206/45.2 |
| 1,324,669 | 12/1919 | Harris | 206/45.19 X |
| 1,636,387 | 7/1927 | Peirce | 206/45.2 |
| 1,906,822 | 5/1933 | Shields | 206/76 |
| 2,606,708 | 8/1952 | Irvan | 220/356 |
| 3,085,839 | 4/1963 | Gallagher | 206/45.2 X |
| D140,985 | 4/1945 | Sawyer | 206/45.11 UX |

FOREIGN PATENTS OR APPLICATIONS

| | | | |
|---|---|---|---|
| 930,555 | 8/1947 | France | 206/508 |
| 572,551 | 10/1945 | United Kingdom | 206/508 |

*Primary Examiner*—Leonard Summer
*Attorney, Agent, or Firm*—J. B. Felshin

[57] ABSTRACT

This jewelry box comprises a case and a cover which can be assembled in closed condition to form a cube or rectangular prism. In such condition the case has a top forwardly and downwardly slanting top socket carrying a forwardly and downwardly slanting pad slit to receive part of a piece of jewelry such as a ring. The cover has a downwardly and forwardly slanting underside to match the top of the case and pad. In closed condition, with the cover on the case, the box is in shape of a cube or rectangular prism. The cover can be taken off and fitted to the underside of the case with the front of the cover flush with the rear of the case, so that the exposed pad at the top of the case slants downwardly and forwardly at a greater angle than when the cover is on top of the case, for better display of the jewelry.

13 Claims, 10 Drawing Figures

JEWELRY BOX

This invention relates to jewelry boxes.

An object of this invention is to provide a jewelry box comprising a bottom case having a downwardly and forwardly slanting top and a horizontal bottom and a cover for the case having a downwardly and forwardly slanting underside matching the top of the case, and a horizontal top, so that when the cover is on the case in closed condition, the box is in shape of a cube or rectangular prism.

Another object of this invention is to provide a box of the character described comprising a case having a downwardly and forwardly slanting recess at its upper end receiving a pad slit to receive part of a piece of jewelry.

Yet another object of this invention is to provide a box of the character described which is equal in dimension from front to rear and from side to side so that the case has a square underside and vertical walls, and the cover has a square top wall from which vertical walls extend downwardly.

Still another object of this invention is to provide a box of the character described comprising a case and cover for the case which have frictionally interfitting means to hold the case and cover in closed condition or in display condition.

Yet another object of this invention is to provide a box of the character described in which the cover can be removed from the top of the case and fitted onto the underside of the case.

A further object of this invention is to provide a box of the character described in which the side and end walls (front or rear) of the case and cover are flush when the cover is on top of the case to close the box, and when the cover is at the underside of the case in display condition of the box.

A still further object of this invention is to provide a strong and durable box of the character described which shall be relatively inexpensive to manufacture, attractive in appearance, easy to manipulate to closed or display positions, and which shall yet be efficient to a high degree.

Other objects of this invention will in part be obvious and in part hereinafter pointed out.

The invention accordingly consists in the features of construction, combinations of elements, and arrangement of parts which will be exemplified in the construction hereinafter described and of which the scope of invention will be indicated in the following claims.

Figure 1:
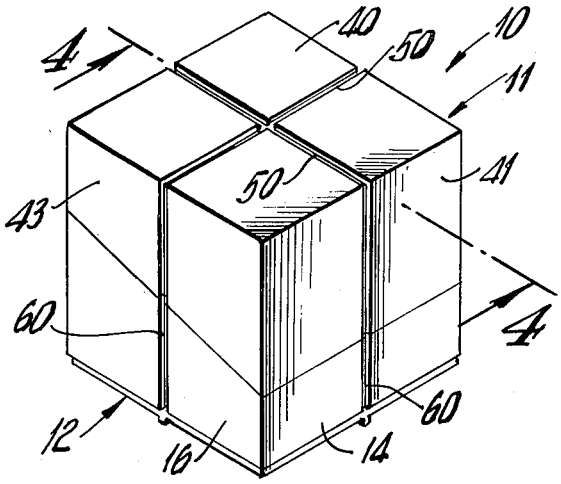
FIG. 1 is a top front perspective view of a box embodying the invention shown in closed condition.
Figure 2:
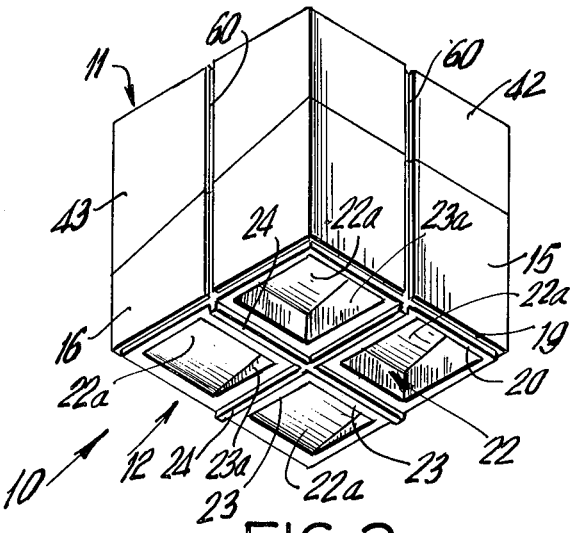
FIG. 2 is a rear bottom perspective view of the box shown in FIG. 1.
Figure 3:
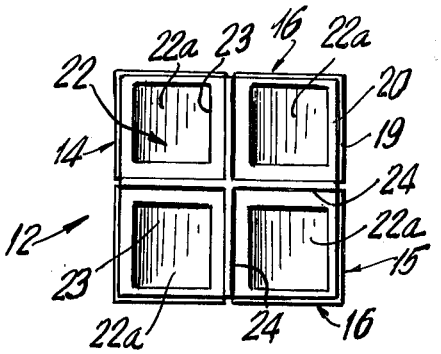
FIG. 3 is a bottom plan view of the case.
Figure 6:
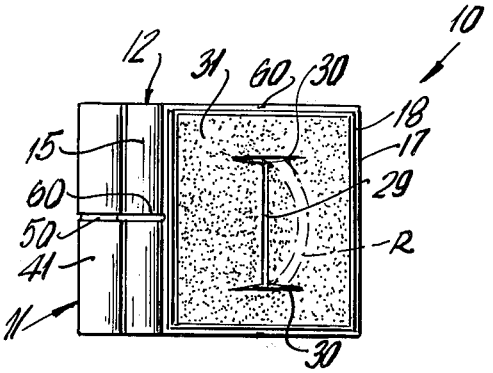
FIG. 6 is a top plan view of the structure shown in FIG. 5.
Figure 4:
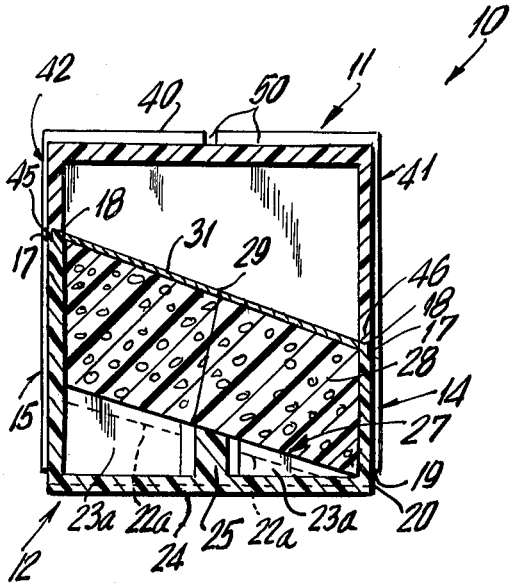
FIG. 4 is a cross-sectional view taken on line 4—4 of FIG. 1.
Figure 5:
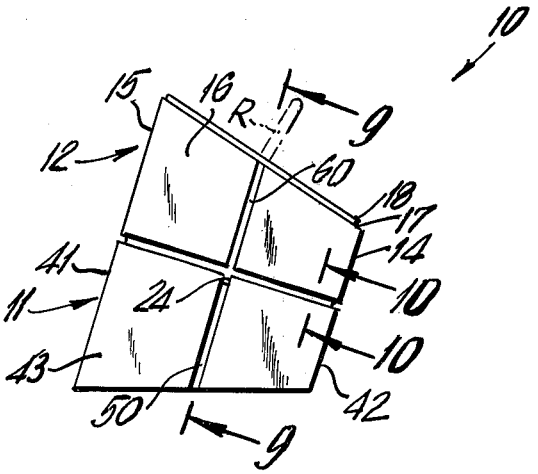
FIG. 5 is a side elevational view of the box in display condition with the cover turned around from front to rear and fitted onto the underside of the case.
Figure 7:
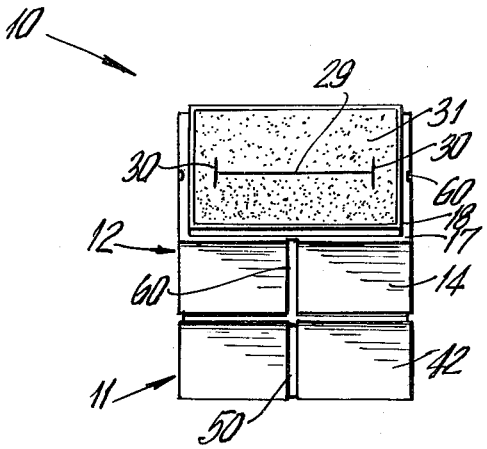
FIG. 7 is a front view of the structure shown in FIG. 5.
Figure 8:
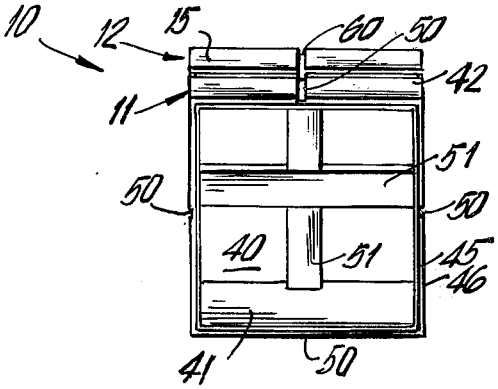
FIG. 8 is a bottom plan view of the structure shown in FIG. 5.
Figure 9:
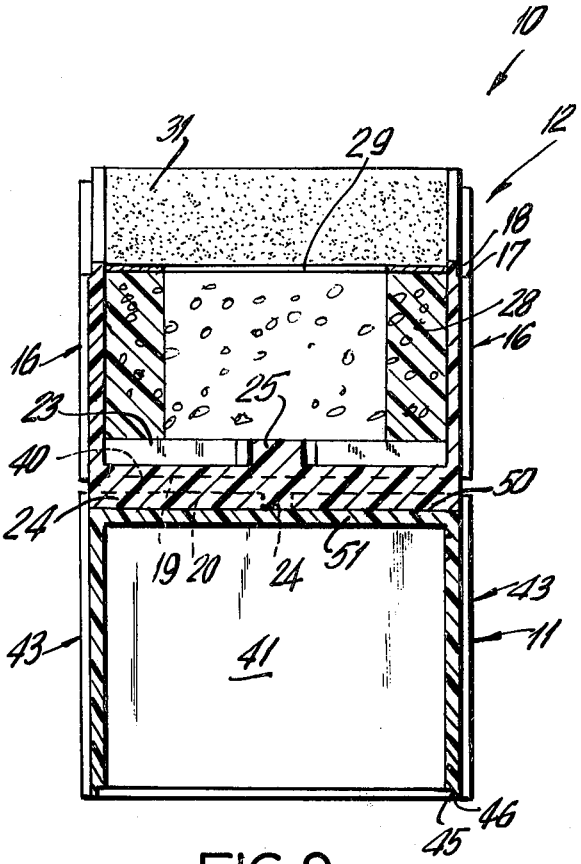
FIG. 9 is cross-sectional view taken on line 9—9 of FIG. 5.
Figure 10:
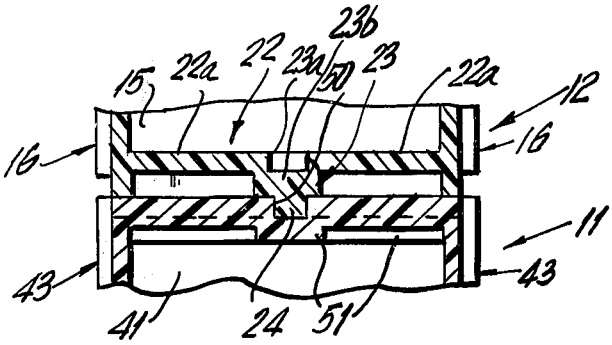
FIG. 10 is a cross-sectional view taken on line 10—10 of FIG. 5.

Referring now in detail to the drawing, 10 designates a jewelry box such as a ring box, embodying the invention and shown in closed condition in FIGS. 1 and 2 and in display condition in FIGS. 5 to 10. The ring or other article of jewelry R can also be displayed by merely removing the cover 11 from the case 12. In closed condition the assembled box is a rectangular prism in shape, specifically a cube.

The case 12 is preferably molded of rigid plastics. Said case 12 comprises a front wall 14, a rear wall 15 parallel to wall 14, and parallel side walls 16. When the box is closed, the bottom of the case is in horizontal plane and the front, rear and side walls are in vertical planes. The front wall extends to a lesser height than the rear wall and the upper ends of the side walls slant downwardly and forwardly. The upper ends of the side walls and the front and rear walls are indented inwardly to form shoulders 17 and flanges 18 all around. The lower ends of said front and rear walls and said side walls are indented inwardly to form shoulders 19 and flanges 20 all around.

The case 12 is also formed with a bottom wall 22 which slants downwardly and forwardly in parallel relation to the upper edges of side walls 16 and extending from above the lower end of the rear wall 15 down to the lower end of front wall 14. Said wall 22 has four substantially square portions **22*a* in the four corners of the case. Said four coplanar portions 22*a* are interconnected by downwardly extending, upwardly opening crossing vertical channel brace portions 23. Said brace portions 23 each have side walls 23*a* connected by a bottom web 23*b*. Extending down from the centerlines of the webs 23*b* are ribs 24 for the purpose hereinafter appearing. The ribs 24 cross one another centrally. The brace portions 23 may meet where they cross as at 25. The wall portions 22*a* are thus inclined upwardly from the lower end of the case and form the bottom of a depression or recess 27** in the case. Said recess is parallel at its sides, vertical at front and rear and slants downwardly and forwardly.

Inserted into the recess is a pad 28 preferably of soft polyurethane. The pad has parallel vertical sides, a vertical front end, a vertical rear end and slants downwardly and forwardly at top and bottom to substantially fill the recess 27. The pad can be slit transversely as at 29 perpendicularly to the plane of wall portions **22*a* and at the ends of slit 29, as at 30 so that the band of a ring R or any portion of a piece of jewelry can be inserted into slit 29** with the head or part of the jewelry projecting above the pad for purpose of display.

The pad 28 may have a tougher layer 31 at the top, and may be glued into the recess if desired.

The cover 11 may also be a plastic rigid moulding. Said cover 11 has a top horizontal wall 40, a vertical front wall 41, a vertical rear wall 42, and parallel side walls 43. Said side walls 43 have downwardly and forwardly slanting lower edges complementary to the top edges of side walls 16 of the case. The front wall 41 of the cover is as high as the rear wall 15 of the case. The rear wall 42 of the cover is as high as the front wall 14 of the case. Thus when the box is in closed condition as shown in FIGS. 1–4, the box is a cube. The front and rear walls of the case and cover could be of greater or lesser dimension, end to end, than the side walls, in which case the box would not be a cube but would still be a rectangular prism.

The lower edges of walls 41, 42, 43 of the cover are indented outwardly from their inner sides to provide outer flanges 45 and inner shoulders 46 to frictionally interfit with the flanges 18 and shoulders 17 of the case.

The top wall 40 of the cover is formed with crossing grooves 50 meeting centrally. At the underside of top wall 40 of the cover there are crossing flat ribs 51. The grooves 50 are aligned with the ribs 51.

In FIGS. 5 to 10 the box 10 is shown in display condition with the cover pried off the case, then turned 180° from front to rear and placed underneath the case so that walls 41 and 15 are coplanar or flush, and walls 42 and 14 are coplanar or flush. In such position the ribs 24 of the case frictionally fit into the grooves 50 of the cover to hold the case and cover together. In the display position, the walls 15, 41 slant upwardly and forwardly in parallel relation to walls 42, 14. The top surface of pad 28 slants, in the display position, at twice the angle of the top of the pad in the closed position of the box.

The walls 15, 42, 16, 43 and 14, 41 may have grooves 60 for decorative purposes if desired.

It will be understood that the ring R or other piece of jewelry may be displayed by merely removing the cover from the case.

Also it will be understood that one closed box 10 may be placed beneath a box 10 in display condition (as in FIG. 5) to support the display box in raised position.

It will be noted that in the display position of the box, the shape of the bottom of the case (square) is exactly the shape of the top of the cover (square) to allow a good interfitting of the case and cover.

It will thus be seen that there is provided an article in which the several objects of this invention are achieved, and which is well adapted to meet the conditions of practical use.

As possible embodiments might be made of the above invention, and as various changes might be made in the embodiments above set forth, it is to be understood that all matter herein set forth or shown in the accompanying drawings, is to be interpreted as illustrative only.

I claim:

1. A jewelry box comprising a case and a cover, said case, in the closed condition of the box, having a downwardly and forwardly slanting top end and a horizontal bottom end, said cover being on top of the case and having a horizontal top end and a downwardly and forwardly slanting bottom end, and said case and cover having vertical coplanar front walls and vertical coplanar rear walls, said case having a recess at its top end, a pad in the recess of said case, said case and cover having cooperative frictionally interfitting means at said top slanting end of the case and at the bottom slanting end of said cover, in said closed condition of said box, said cover being separable from and removable from said case, and said case and cover having cooperative means at said horizontal bottom end of the case and at said top horizontal end of the cover to frictionally interfit one another, in an open, display condition of the box, with the case on the cover and with the top end of the cover contacting the bottom end of the case, and with the top of the case exposed, the bottom end of the cover in said open display condition of the box, being in a horizontal plane, with the contacting top end of the cover and bottom end of the case, slanting downwardly and forwardly, with the top end of the case slanting downwardly and forwardly at a greater angle than the angle of slant of the contacting top end of the cover and bottom end of the case, and with the rear wall of the cover and front wall of the case in alignment at the front of the box and slanting upwardly and forwardly, and with the rear wall of the case and the front wall of the cover in alignment at the rear of the box and slanting upwardly and forwardly, and said case and cover each having left and right side walls, with the left side walls of the case and cover in alignment and vertical, in the closed condition of the box and the right side walls of said case and cover also being in alignment and vertical in said closed condition of the box, and the left side wall of the case being in alignment with the right side wall of the cover in said open display condition of said case.

2. The combination of claim 1, the front wall of the case being of the same height as the rear wall of the cover, and the rear wall of the case being of the same height as the front wall of said cover in the closed position of the box.

3. The combination of claim 1, the side walls of said cover and case being of the same depth from front to rear, as the length of said front and rear walls, from side to side.

4. The combination of claim 1, the front wall of said case being of the same height as the rear wall of the cover, and the rear wall of said case being of the same height as the front wall of said cover, the side walls of said cover and case being of the same depth from front to rear, as the length of said front and rear walls, from side to side.

5. The combination of claim 1, said recess being formed by a bottom wall in said case which slants downwardly and forwardly in parallel spaced relation to the upper end of the case.

6. The combination of claim 5, said bottom wall of said recess comprising coplanar wall portions connected by crossing, brace portions.

7. The combination of claim 6, said brace portions being channel shaped and opening upwardly.

8. The combination of claim 1, said means to frictionally interfit the bottom end of the cover with the top end of the case. comprising indented walls on said case and cover forming flanges and shoulders, the flanges of the case interfitting with the flanges of the cover, and the shoulders of the case contacting the shoulders of said cover.

9. The combination of claim 8, said cooperative means at said horizontal bottom end of said case and at the top end of said cover comprising ribs at the underside of said bottom end of said case adapted to frictionally interfit with grooves formed in the upper side of the top end of said cover.

10. The combination of claim 1, said box, in the closed position thereof, being cubical in shape, the top of said case, in the display condition of the box having twice the angle to the horizontal, than the angle of said top of the case in the closed condition of the box.

11. A jewelry box comprising a case, a cover separably and removably mounted on the case, said case having a downwardly and forwardly slanting upper end, said cover having a forwardly and downwardly slanting underside, contacting the upper end of said case, said cover having a horizontal top, said case having a horizontal bottom, said case and cover having coplanar front, rear and side walls, said case having a recess in its upper end, a pad in said recess, said pad having a slit to receive part of a piece of jewelry, said cover being hollow at its underside, said cover and case having frictionally interfitting means at the underside of the case and at the upper end of the cover, when the cover is removed from top of the case and turned 180° from front to rear, and applied to the underside of said case.

12. The combination of claim 11, said case having a slanting wall parallel to its upper end and forming a bottom for said recess.

13. The combination of claim 11, said box, in the closed condition thereof, being of cubical shape.

* * * * *

Disclaimer 3,942,632.—*Robert S. Witkoff*, Glen Cove, N.Y. JEWELRY BOX. Patent dated Mar. 9, 1976. Disclaimer filed Aug. 24, 1977, by the assignee, *The Alsten Company*.

The term of this patent subsequent to Dec. 30, 1989, has been disclaimed.

[*Official Gazette December 6, 1977.*]